US007434817B2

(12) United States Patent
Rush

(10) Patent No.: US 7,434,817 B2
(45) Date of Patent: Oct. 14, 2008

(54) MECHANIC'S CREEPER

(76) Inventor: Garland Rush, 43 Vineyard Cir., Sonoma, CA (US) 95476

( * ) Notice: Subject to any disclaimer, the term of this patent is extended or adjusted under 35 U.S.C. 154(b) by 144 days.

(21) Appl. No.: 11/251,703

(22) Filed: Oct. 17, 2005

(65) Prior Publication Data

US 2006/0082084 A1 Apr. 20, 2006

Related U.S. Application Data

(60) Provisional application No. 60/619,149, filed on Oct. 15, 2004.

(51) Int. Cl.
*B25H 5/00* (2006.01)

(52) U.S. Cl. ..... 280/32.5; 280/32.6

(58) Field of Classification Search ..... 280/32.5, 280/32.6; D34/23
See application file for complete search history.

(56) References Cited

U.S. PATENT DOCUMENTS 3,751,758 A * 8/1973 Higbee et al. ..... 16/35 R
D270,962 S * 10/1983 Martell ..... D34/23
5,527,051 A * 6/1996 Plaza ..... 280/32.6
5,942,068 A * 8/1999 Adams et al. ..... 156/112
6,871,861 B2 * 3/2005 Hernandez, Jr. ..... 280/32.6
6,969,077 B2 * 11/2005 Liu ..... 280/30
7,032,908 B2 * 4/2006 Melvin ..... 280/32.6

* cited by examiner

*Primary Examiner*—Christopher P. Ellis
*Assistant Examiner*—Brian Swenson
(74) *Attorney, Agent, or Firm*—Larry D. Johnson

(57) ABSTRACT

An improved mechanic's creeper apparatus for use when working under a vehicle and the like includes a frame having an upper end, lower end, right side, and left side frame portions. A contoured deck or body platform is supported between the right and left sides. Each side bears at least three casters with wheels arranged in a non-collinear arc to prevent capture in a crack or expansion joint on the floor of the workplace. The upper end carries a height-adjustable headrest which remains parallel to the plane of the body platform when raised.

8 Claims, 3 Drawing Sheets

MECHANIC'S CREEPER

CROSS REFERENCE TO RELATED APPLICATIONS

The present application claims the benefit of the filing date of U.S. Provisional Patent Application Ser. No. 60/619,149, filed 15 Oct. 2004.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to utility carts and platforms, and more particularly to an improved mechanic's creeper apparatus for use when working from a supine or sitting position, such as when working under a vehicle.

BACKGROUND INFORMATION AND DISCUSSION OF RELATED ART

Workers in the automotive, farm equipment, marine, airline, computer hardware, and other industries often must work from a supine or sitting position. For example, working under a vehicle for automobile repair can be a backbreaking task due to the use of uncomfortable, utilitarian creepers which offer little in the ways of comfort or convenience. Headrests on conventional creepers are either fixed or simply pivot forward, the effect of these models is to push the user's chin into the chest, creating an uncomfortable and contorted position. In addition, the wheels or casters on existing creepers are prone to being caught in cracks or expansion joints on the workplace floor.

U.S. Pat. No. 4,721,316 to Whiteside discloses a blow-molded creeper which includes a flat upper surface having a head rest for the mechanic. The shell of the creeper includes an upper sheet and a lower sheet. In the lower sheet are a plurality of ribs and truncated cones which project upwardly into engagement with the thermoplastic upper sheet which forms the upper surface of the creeper. The ribs and truncated cones are bonded to the upper surface to provide structural integrity.

U.S. Pat. No. 4,792,147 to Wissing describes a mechanics creeper which has a molded body shell with upturned peripheral edges or walls forming a receiving area within the walls for receiving the head and torso of a user. Wheels are mounted on the body shell so that the shell can easily roll over various types of surfaces with the upturned peripheral walls protecting the user from water, mud, or other materials and from striking unseen objects as the creeper is moved. The wheels may be removable so that the body shell, having a smooth outside contour, may slide over surfaces such as mud, sand, or snow, or through rubble were wheels are unuseable.

U.S. Pat. No. 4,875,694 to Hamrick teaches an improved mechanic's creeper apparatus including a flat, generally rectangularly configured platform, the four corner portions of which may be tapered for streamlining. The device includes a longitudinal support axis (axis of symmetry) along which are positioned head end and foot end casters, and a transverse support axis disposed nearer the foot end of the platform than to the head end and along which are positioned side casters. Upstanding fenders are disposed at the four caster locations for mounting the caster devices to the platform. A head rest is also provided at the head end of the device and extends over the fender disposed at the head end.

U.S. Pat. No. 5,330,209 to Pool discloses a low profile mechanics creeper which includes a closed loop, unitary metal frame supported by heavy duty casters recessed at spaced intervals in the frame. The frame is comprised of a single, closed loop rectangular shape, and a single cross member attached to opposite sides of the frame to assist in support of a platform. The creeper is thus configured to define a low profile while minimizing any obstructions to the user's field of motion.

U.S. Pat. No. 5,503,415 to Powell describes an auto mechanics creeper having side rails such that trays may be temporarily attached to either rail by sliding a lip of the respective tray into a slot between the creeper platform and the rail.

U.S. Pat. No. 6,641,146 to Reese teaches a creeper having a base originally used for an engine hoist. The base has wheels for easy mobility. The base in its original form may look like an A-shape when viewed from above. Alternatively, the base is modified to accommodate a tilt front end vehicle like a tractor trailer truck. The height adjuster is an extendable/retractable device such as a hydraulic cylinder. A support beam connects the base to a platform. A vertical arm support, which is preferably metal, keeps the height adjuster in proper alignment for the range of movement of the platform. The platform has a frame. Although the frame can be any number of pieces, it is two pieces in this embodiment. The two pieces include a body section and a chest board section connected by a pivot plate. The entire platform can be folded down for easy storage. Each section is preferably padded with a body pad and a chest pad, respectively. There are preferably three platform pivot points: a first pivot point which attaches the platform to the support beam, a second pivot point where the height adjuster is mounted, and a third pivot point between the chest board and the body board.

U.S. Pat. No. 6,702,305 to Miles discloses an inclinable creeper including a carriaged framework supporting a bed, the bed including an inclinable portion and a mechanism for raising the inclinable portion upon actuation of a lever, for securing the inclinable portion when the lever is not actuated, and for allowing the inclinable portion to be forcibly lowered when the lever is actuated.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an improved mechanic's creeper apparatus for use when working under a vehicle and the like. The inventive apparatus includes a frame having an upper end, lower end, right side, and left side frame portions. A contoured deck or body platform is supported in the frame between the right and left sides. Each side bears at least three casters with wheels arranged in a non-collinear arc to prevent capture of all of the wheels in a crack or expansion joint on the floor of the workplace. The upper end carries a height-adjustable headrest which remains parallel to the plane of the body platform when raised.

The inventive mechanic's creeper is ergonomically designed, with a fully supportive lumbar curve on the body platform and an infinitely-adjustable articulated headrest. The geometry of the headrest allows adjustment for maximum comfort and correct alignment with the spine, lessening muscle stress and fatigue. Inset tool trays and drink holders provide the convenience of having tools close at hand, and shortens work time by eliminating unnecessary trips to the toolbox. The frame may be formed from TIG-welded aluminum tubing, which may anodized or powder coated, and which is light in weight and provides strength in its race car-like design and construction.

The inventive creeper may be suspended on shock-absorbing springs attached to easy-rolling custom designed casters with urethane wheels. This combination of features allows the creeper to roll over uneven surfaces and small obstacles such as rocks, nuts, bolts, and other garage debris with minimum interference. The springs reduce the impact to the structural components when weight is initially placed on the creeper, or if the creeper is dropped, which helps to ensure the longevity of the frame.

It is therefore an object of the present invention to provide a new and improved mechanic's creeper.

It is another object of the present invention to provide a new and improved mechanic's creeper that is comfortable and efficient to use.

A further object or feature of the present invention is a new and improved mechanic's creeper that is not prone to capture in a crack or expansion joint on the floor of the workplace.

An even further object of the present invention is to provide a novel headrest arrangement for a mechanic's creeper.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
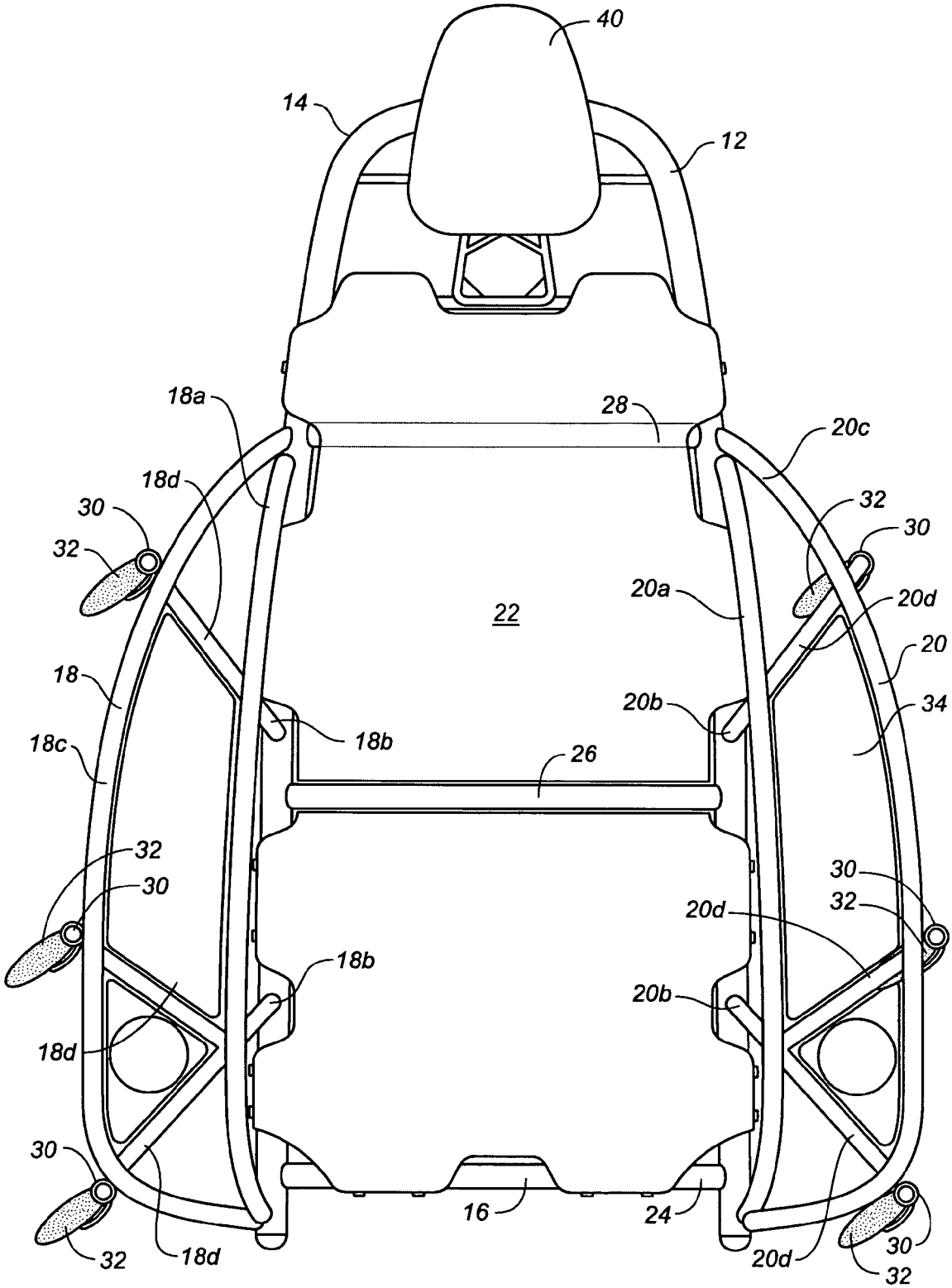
FIG. 1 is a top plan view of a mechanic's creeper of this invention.

Referring to FIGS. 1 through 4, wherein like reference numerals refer to like components in the various views, there is illustrated therein a new and improved mechanic's creeper apparatus, generally denominated 10 herein.

FIG. 1 is a top plan view of the mechanic's creeper 10 of this invention. The inventive apparatus includes a frame 12 having an upper end 14, lower end 16, right side 18, and left side 20 frame portions. Each side portion may include an inner tubular arm 18*a*, 20*a*; supported on the frame 12 by side arm braces 18*b*, 20*b*; and an outer side arm 18*c*, 20*c*; attached to the inner side arms by side braces 18*d*, 20*d*, respectively. A contoured deck or body platform 22 made of covered and padded ABS plastic is supported in the frame 12 between the right and left sides 18, 20, and may include lower brace 24, middle brace 26, and upper brace 28. Each side 18, 20 bears at least three casters 30 with wheels 32 arranged in a non-collinear arc to prevent capture in a crack or expansion joint on the floor of the workplace. One or more plastic trays 34 supported on the sides 18, 20 may serve as tool caddies or drink holders. The upper end 14 carries a height-adjustable headrest 40, described in more detail below.

Figure 2:
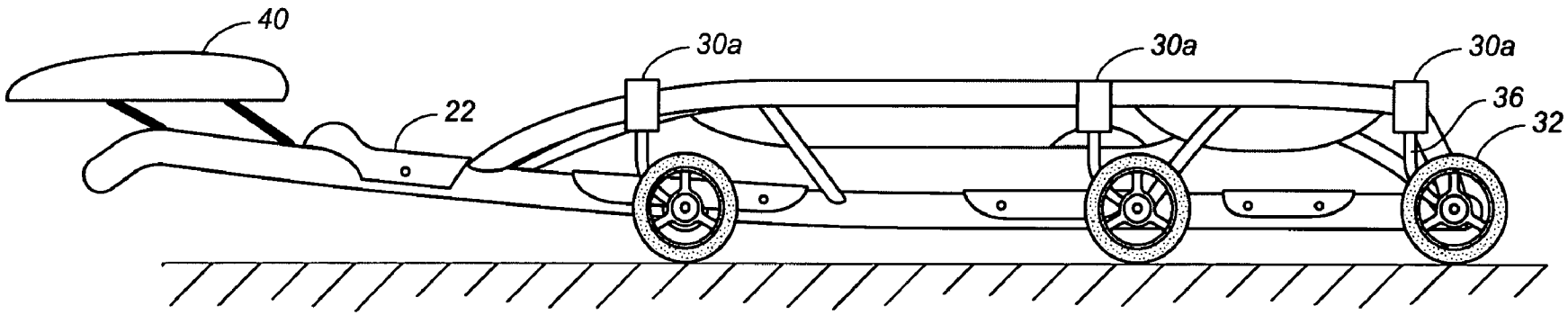
FIG. 2 is a right side elevation view of the mechanic's creeper of FIG. 1.

FIG. 2 is a right side elevation view of the mechanic's creeper of FIG. 1. This view illustrates the generally parallel alignment of the headrest 40 with the body platform 22 when the headrest is in its lowered position.

Caster sleeves 30*a* may include springs or shock absorbers for increased comfort. The wheels 32 are preferably urethane, in-line skate type wheels for smoother rolling, less rolling resistance, minimal contact patch, cushioning and shock absorption, and a high friction rate for resistance to lateral sliding.

Figure 3:
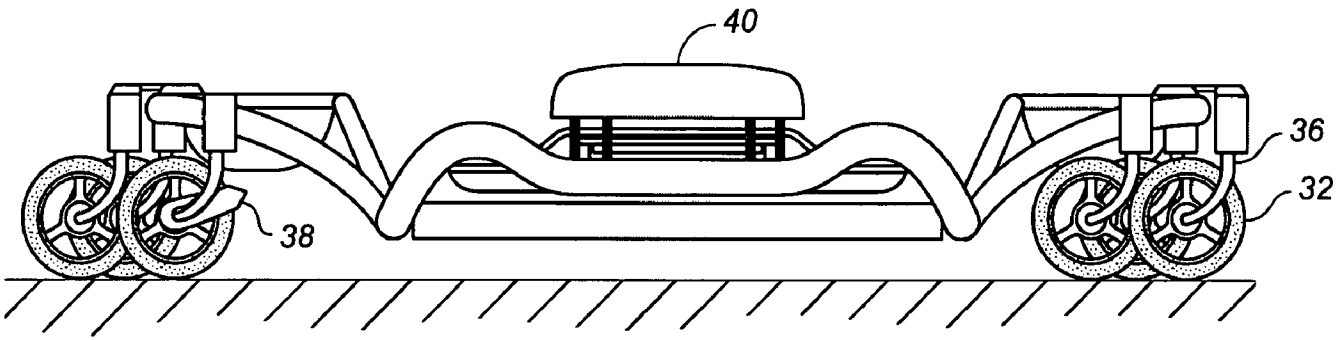
FIG. 3 is an upper end elevation view of the mechanic's creeper of FIG. 1.

FIG. 3 is an upper end elevation view of the mechanic's creeper of FIG. 1. This view illustrates the wheels 32 supported on vertical axles 36 bent ninety degrees. This configuration decreases the radius of the arc or swivel of the wheels, and enables the creeper to get into a tighter clearance (i.e., the wheels are not outboard of the frame). Brakes 38 may be used to lock the wheel(s) in place.

Figure 4:
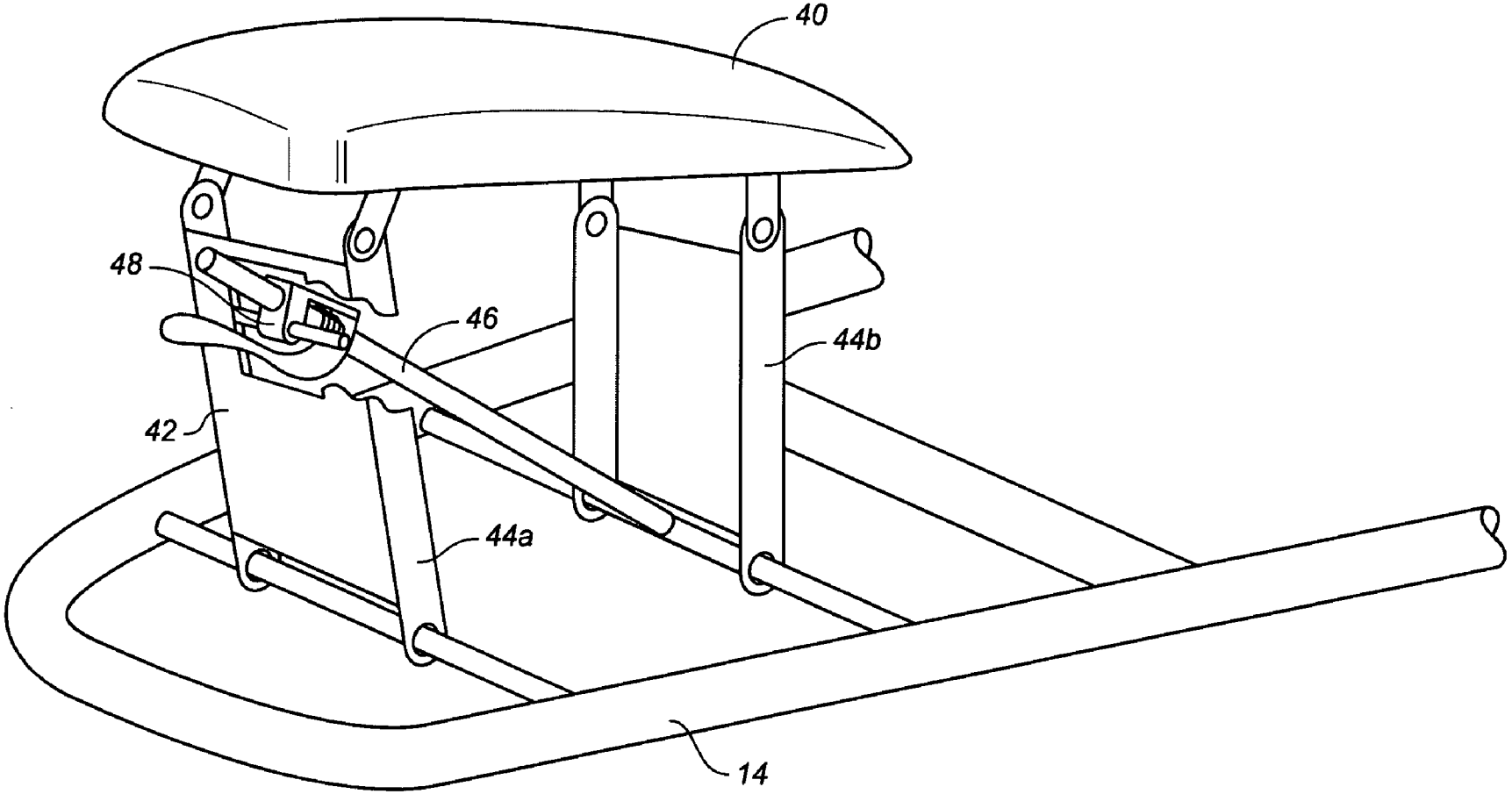
FIG. 4 is a perspective view of the adjustable headrest and raising mechanism, with the headrest in its raised position.

FIG. 4 is a perspective view of the adjustable headrest 40 and its raising mechanism 42, illustrating the continued generally parallel alignment of the headrest 40 with the body platform when the headrest is in its raised position. Raising mechanism 42 may include a pair of hinged supports 44*a*, 44*b*, interconnected with a shaft 46 selectively extensible through a locking sleeve 48, such that adjustment of the shaft and hinging of the supports raises and lowers the headrest while maintaining its generally horizontal attitude.

The inventive mechanic's creeper may be made in any appropriate size or scale. For example, the creeper may be approximately 40 inches long, 28 inches wide, and 5 inches high, including one inch of ground clearance, with a weight capacity of 450 pounds.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A mechanic's creeper apparatus comprising:

a frame having an upper end, lower end, right side, and left side frame portions, said upper end carrying a height-adjustable headrest;

a body platform supported by said frame between said right side portion and said left side portion;

at least three wheels carried on each side frame portion and arranged in a non-collinear arc to prevent capture in a crack on the floor of the workplace; wherein said height-adjustable headrest remains parallel to the plane of said body platform when raised to allow adjustment for maximum comfort and correct alignment with the user's spine.

2. The mechanic's creeper of claim 1 wherein said body platform comprises a contoured deck.

3. The mechanic's creeper of claim 1 wherein at least one of said side frame portions includes a tool tray.

4. The mechanic's creeper of claim 1 wherein said frame is constructed of aluminum tubing.

5. The mechanic's creeper of claim 1 wherein said wheels include shock absorbers.

6. The mechanic's creeper of claim 1 wherein said body platform is constructed of ABS plastic.

7. The mechanic's creeper of claim 1 wherein said wheels comprise urethane in-line skate wheels.

8. The mechanic's creeper of claim 1 wherein said wheels are supported on vertical axles bent 90 degrees.

* * * * *